United States Patent [19]

Takamizawa et al.

[11] 3,946,181

[45] Mar. 23, 1976

[54] PUSH BUTTON-TYPE SWITCH

[76] Inventors: Koji Takamizawa, 795 Asahi Kamishirrane-cho, Yokohama, Kanaga; Shitiro Shimizuhata, 2130 Yamazaki-cho, Machida, Tokyo; Akinori Shinonaga, 324-4 Shimoishihara, Chofee, Tokyo; Masaru Tsuruta, 1-24 Nishiki-cho, Tachikawa, Tokyo, all of Japan

[22] Filed: June 11, 1974

[21] Appl. No.: 478,303

[30] Foreign Application Priority Data

June 15, 1973 Japan ..... 48-70057[U]

[52] U.S. Cl. ..... 200/159 R; 200/153 V

[51] Int. Cl.[2] ..... H01H 13/52; H01H 3/48

[58] Field of Search ..... 200/163, 159 A, 159 R, 200/153 V, 164 R, 164 A

[56] References Cited

UNITED STATES PATENTS

| | | | |
|---|---|---|---|
| 2,521,561 | 9/1950 | Batcheller | 200/163 X |
| 3,061,692 | 10/1962 | Fowler | 200/163 X |
| 3,818,169 | 6/1974 | Kobernus | 200/159 A |

FOREIGN PATENTS OR APPLICATIONS

| | | | |
|---|---|---|---|
| 1,901,469 | 1/1969 | Germany | 200/153 V |
| 1,225,742 | 9/1966 | Germany | 200/153 V |

*Primary Examiner*—Robert K. Schaefer
*Assistant Examiner*—William J. Smith
*Attorney, Agent, or Firm*—Oblon, Fisher, Spivak, McClelland & Maier

[57] ABSTRACT

A push button-type switch comprising a rectangular casing having parallel end walls, parallel side walls and a bottom wall and opening at the top, said end walls, side walls and bottom wall defining a switching chamber therebetween, a key stem extending vertically within and projecting upwardly of said switching chamber for upward and downward movement; a return spring disposed about said key stem for normally urging the key stem upwardly, a movable spring contact carried by said key stem within said switching chamber for movement between engaging and disengaging positions; and stationary contact means on said side walls to be engaged by said movable spring contact.

4 Claims, 8 Drawing Figures

PUSH BUTTON-TYPE SWITCH

BACKGROUND OF THE INVENTION

This invention relates to a push button-type switch and more particularly, to a push button-type switch adapted to be suitably employed in connection with an electronic desk computer.

There have been proposed and practically employed a great variety of push button-type switches for use with electronic desk computers and in one most common type one of the conventional push button-type switches for electronic desk computers, since the position of the point where the circuit associated with the switch is switched on coincides with that of the point where the circuit is switched off, when the user intends to actuate the switch to switch on or off by pushing the button of the switch down, if his finger trembles or springs, vibration corresponding to such movement of the finger is directly transmitted to the movable switching spring contact to thereby cause the contact to engage the mating stationary contact so as to erroneously actuate the switch against his intended operation mode. Furthermore, in such a conventional push button-type switch, one pushing-down operation may cause a number of cycles of switching operations to take place which impede proper operation of the electric circuit associated with the switch. Such disadvantages are due to the fact that the switch is not provided with means for absorbing any excess amount of the movement of the user's finger.

SUMMARY OF THE INVENTION

Therefore, one principal object of the present invention is to provide a novel and improved push button-type switch which can effectively eliminate the disadvantages inherent in the conventional push button-type switch referred to above.

Another object of the present invention is to provide a novel and improved push button-type switch which is provided with means for absorbing any excess movement of the operator's finger to thereby eliminate any erroneous actuation of the switch.

Another object of the present invention is to provide a novel and improved push button-type switch in which a movable spring contact has positively defined switching on and switching off positions to thereby eliminate possible erroneous actuation of the switch.

A still further object of the present invention is to provide a novel and improved push button-type switch in which the movable spring contact moves in response to the pushing down force by the user's finger in a time lag relationship to the finger's movement.

A still further object of the present invention is to provide a novel and improved push button-type switch which has a relatively simple construction with no special parts added thereto for attaining the above-mentioned objects.

According to the present invention, there is provided a push button-type switch which comprises in combination a rectangular casing including parallel side walls, parallel end walls and a bottom wall and opening at the top, said side, end and bottom walls defining a switching chamber therebetween, a key stem received within said switching chamber with a portion thereof extending upwardly through said open top of the casing for limited upward and downward movement, a return spring disposed about said extension of the key stem for normally urging the key stem in its uppermost position, a movable spring contact received within said switching chamber to be driven by said key stem and stationary contact means secured to said side walls to be engaged by said movable spring contact, characterized by that said key stem includes a bifurcated base portion with opposite legs at the lower end of the key stem received within said switching chamber and a cross bar extending between said legs in a spaced relationship to the underside of said base portion and said movable spring contact comprises a substantially U-shaped leaf spring having a pair of legs connected at the upper ends and embracing said cross bar, said legs of the spring each having an outwardly warped contacting portion at the lower end adapted to engage said stationary contact means, whereby when said key stem is in its uppermost position a clearance is present between the underside of said base portion of the key stem and the top of said spring contact and when said key stem is in its lowermost position a clearance is present between the underside of said spring contact and said cross bar.

The above and other objects and attendant advantages of the present invention will be more readily apparent to those skilled in the art from a reading of the following detailed description in conjunction with the accompanying drawings which illustrate one preferred embodiment of the invention for illustration purpose only, but not for limiting the scope of the same in any way.

BRIEF DESCRIPTION OF THE DRAWINGS

The accompanying drawings show one preferred form of push button-type switch constructed in accordance with the present invention and in which.

PREFERRED EMBODIMENT OF THE INVENTION

Figure 1:
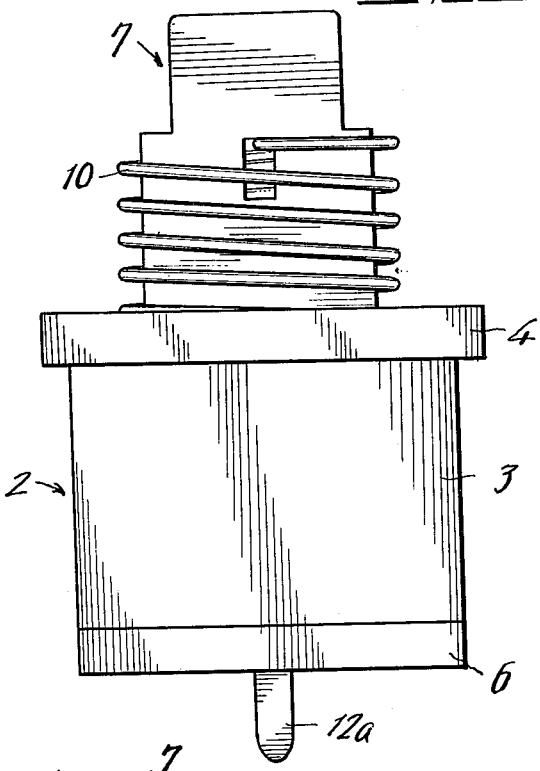
FIG. 1 is a front elevational view of said push button-type switch showing the switch in its "OFF" position.

The present invention will be now described referring to the accompanying drawings and more particularly, to FIGS. 1 through 5 inclusive thereof. The push button-type switch of the invention is generally shown by reference numeral 1 in these Figures. The switch 1 generally comprises a casing 2 which is formed of a dielectric material such as plastic or the like and which includes a rectangular main body or lower portion 3 extending uprightly and a recessed rectangular flange or upper portion 4 integrally extending outwardly and horizontally from the top of the main body portion and then upwardly so as to define a recess 4*a* in the upper surface of the flange for receiving a return spring of which description will be made hereinafter. An elongated opening 4*b* is formed in the top of the main body 2 along the longitudinal axis of the main body extending by a substantial distance of the length of the main body. The opening 4*b* opens into the interior of the casing main body and recess 4*a*, respectively. The upright interior of the main body 3 serves as a switching chamber 5 which is defined by parallel side walls each including a relatively thicker upper portion 5*a* and a relatively thinner lower portion 5*b* and parallel end walls 5*d* connected to the upper portion by a slanted shoulder 5*c*. The switching chamber 5 opens into the opening 4*b* at the top and is closed at the bottom by the bottom wall 6 of the main body 3.

Figure 6:
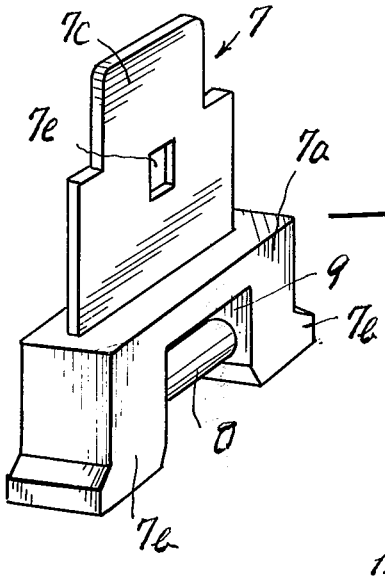
FIG. 6 is a perspective view of the key stem employed in the illustrated embodiment of push button-type switch of the invention.

A vertically movable key stem 7 formed of a dielectric material such as plastic or the like extends upwardly through the opening 4*b* and recess 4*a*. As more clearly shown in FIG. 6, the key stem 7 includes a thicker and wider bifurcated base portion 7*a* comprising a pair of legs 7*b* and a cross bar 8 extending between the legs 7*b* below the arm connecting the legs at their upper ends in a spaced relationship to the underside of the arm so as to define a clearance 9 therebetween for the purpose to be described later. The width of the base portion 7*a* is larger than that of the opening 4*b* so that the base portion is prevented from passing through the opening. The key stem 7 further has a thinner and narrower upper portion 7*c* which extends upwardly from the base portion 7*a* and passes through the opening 4*b*. The width of the upper portion 7*c* is smaller than that of the opening 4*b* and a square window 7*e* is formed in the thinner and narrower upper portion 7*c*. A coiled spring 10 is wound about the thinner and narrower upper portion 7*c* of the key stem 7 with the lower end received in the recess 4*a* in the flange 4 and the upper end anchored to the window 7*e* so as to normally urge the key stem 7 upwardly. The upward movement of the key stem 7 is limited by the abutment of the arm of the base portion 7*a* of the key stem 7 against the underside of the flange 4.

Figure 7:
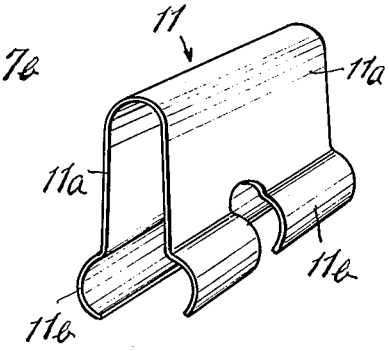
FIG. 7 is a perspective view of the leaf spring-type movable contact employed in the illustrated embodiment of push button-type switch of the invention.

A substantially U-shaped leaf spring contact 11 embrasses loosely and depends from the cross bar 8. As best shown in FIG. 7, the leaf spring contact 11 has a pair of legs 11*a* connected at the upper ends each having an outwardly warped contacting portion 11*b* at the lower end. The leaf spring contact 11 is normally urged upwardly (when the switch is in its "OFF" position) by the action of the return spring 10 so that the outwardly warped contacting portions 11*b* will be positioned above the thinner lower portions 5*b* of the side walls of the main body 3. For the purpose, the length of the leaf spring 11 is so selected that when the switch is in its "OFF" position the contacting portions 11*b* are positioned above the lower thinner side wall portions 5*b* and when the switch is in its "ON" position the contacting portions are received in the lower side wall portions 5*b*. When the switch is in its "OFF" position or more particularly, when the contact switch 11 is in its upwardly urged position by the action of the return spring 10, the clearance 9 is present between the underside of the arm of the base portion 7*a* of the key stem 7 and the top of the leaf spring contact 11 for the playing of the key stem 7.

Figure 8:
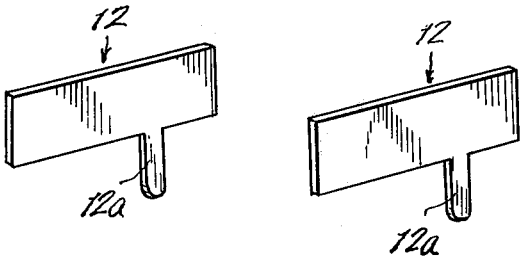
FIG. 8 is a perspective view of stationary contact terminals employed in the illustrated embodiment of push button-type switch of the invention.

Stationary contacts 12 formed of a conductive metal are secured to the lower thinner portions 5*b* of the main body side walls. As best shown in FIG. 8, each of the stationary contacts 12 is in the form of a rectangular metal plate having a depending terminal 12*a* extending from the lower edge of the plate at a point more adjacent to one end than to the other end of the plate. When the contact 12 is held in position on the associated lower side portion 5*b*, the terminal 12*a* extends downwardly through the bottom wall 6 of the main body 3 for connection with a mating contact of the associated electric circuit.

Figure 2:
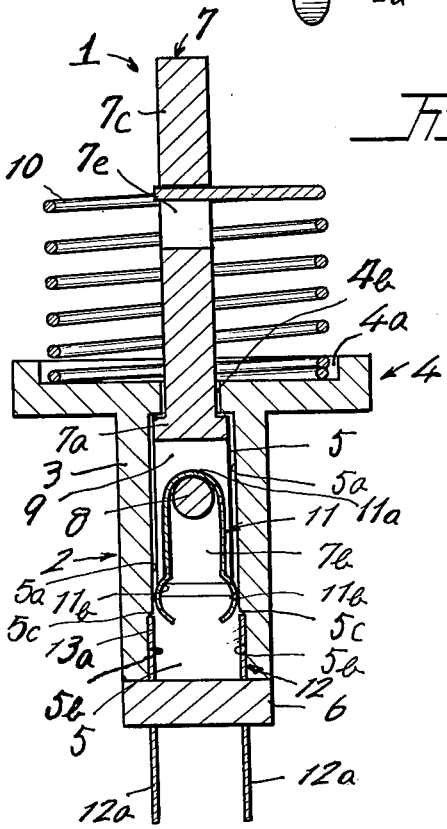
FIG. 2 is an end elevational view in vertical section of said push button-type switch as seen from one side of FIG. 1.
Figure 3:
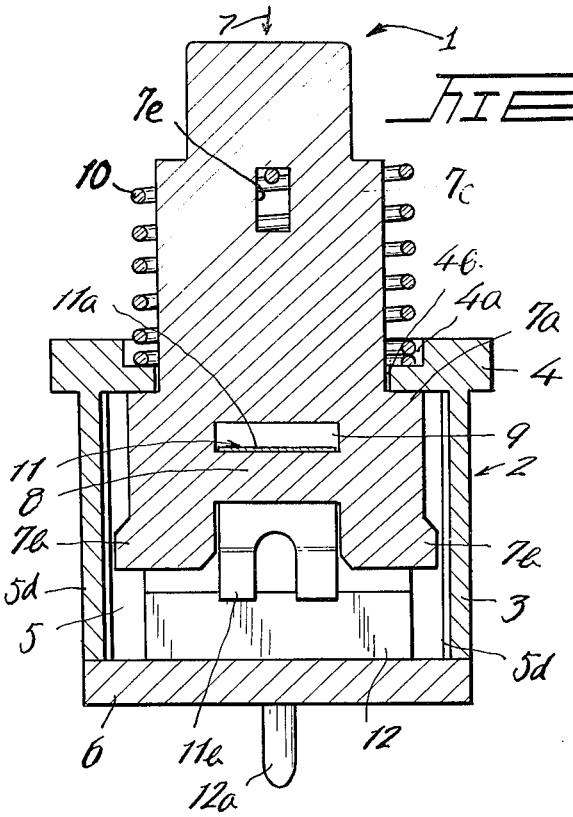
FIG. 3 is a front elevational view in vertical section of said push button-type switch of FIG. 1.

In operation, it is assumed that the push button-type switch is initially in its "OFF" position in which the return spring 10 is not loaded or allowed to extend so as to urge upwardly to and hold the key stem 7 in its uppermost position as shown in FIGS. 1 through 3 inclusive. In the "OFF" position of the push button-type switch, the movable leaf spring contact 11 hangs over the cross bar 8 of the now raised key stem 7 and is disengaged from the stationary contacts 12 on the thinner lower portions 5*b* of the main body side walls whereby the switch is maintained in its "OFF" position and the electric circuit (not shown) leading to the switch is electrically opened.

Figure 4:
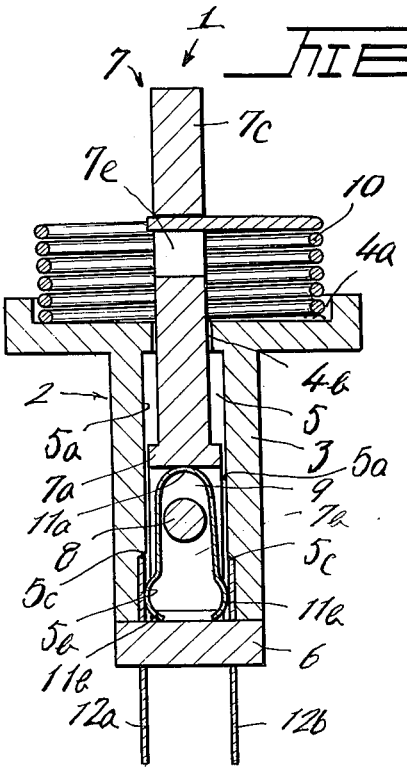
FIG. 4 is a view similar to FIG. 2, but shows said push button-type switch in its "ON" position.
Figure 5:
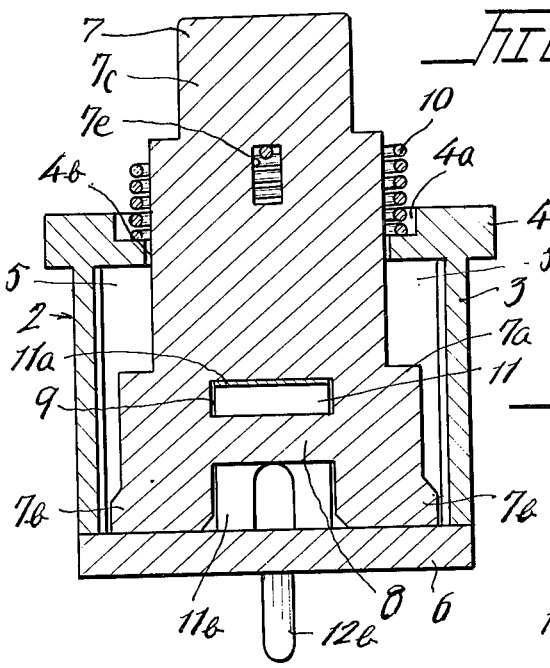
FIG. 5 is a view similar to FIG. 3, but shows said push button-type switch in its "ON" position.

When it is desired to actuate the push button-type switch from the "OFF" position, the user pushes down the key stem 7 against the force of the return spring 10 with his finger until the underside of the arm of the base portion 7*a* of the key stem 7 abuts against the top of the movable leaf spring contact 11 and thereafter, as the user continues to push down the key stem 7, the descending key stem 7 in turn pushes down the movable leaf spring contact 11 which then slides down the slanted shoulders 5*c* and snaps into contact with the stationary contacts 12 on the thinner lower portions 5*b* of the main body side walls as shown in FIGS. 4 and 5 whereupon the switch assumes the "ON" position to close the electric circuit associated with the switch.

Thereafter, when the pushing force is removed from the key stem 7, the key stem 7 is pushed back to the original upper position by the force of the return spring 10. The upward movement of the key stem 7 is not transmitted to the movable spring contact 11 until the cross bar 8 abuts against the underside of the juncture between the pair of legs 11*a* of the contact 11 because of the presence of the clearance or play 9. Therefore, there is no possibility of erroneous or inadvertent actuation of the switch 1 due to any chattering or bounce of the return spring 10. When the cross bar 8 of the key stem 7 abuts against the underside of the juncture between the legs 11*a* of the movable spring contact 11 as the key stem 7 continues to move upwardly, the spring contact 11 follows the upward movement of the key stem 7 whereupon the outwardly warped contacting portions 11*b* disengage themselves from the stationary contacts 12 and slide along the slanted shoulders 5*c* onto the thicker upper portions 5*a* of the main body side walls whereby the switch 1 is again returned to the "OFF" position. The upward movement of the key stem 7 is arrested when the base portion 7*a* of the key stem abuts against the underside of the top of the main body 3 and the movable spring contact 11 also terminates its upward movement. The key stem 7 and spring contact 11 are held in their upper position by the return spring 10. From the foregoing description, it will be understood that when the push button-type switch 1 moves from the "OFF" position to the "ON" position and vice versa, the outwardly warped contacting portions 11*b* on the legs 11*a* of the movable spring contact 11 always move between the two discrete positions through the intermediate slanted shoulders 5*c*. In one of the two positions, the outwardly warped contacting portions 11*b* are in contact with the thicker upper portions 5*a* of the main body side walls and positively held in position and in the other position, the contacting portions 11*b* are in contact with the stationary contacts 12 on the thinner lower portions 5*b* of the main body side walls and also positively held in position whereby the switch 1 is positively held in each of the "OFF" and "ON" positions. Furtheremore, the movement of the spring contact 11 between the two positions is assisted by the slant of the shoulders 5*c* on the main body side walls.

According to the present invention, the movable spring contact 11 is imparted thereto such resilience that the legs 11*a* are always urged outwardly or away from each other so as to bring the outwardly warped contacting portions 11*b* at their lower ends into contact with the thicker upper portions 5*a* of the main body side walls or stationary contacts 12 on the thinner lower portions 5*b* of the main body side walls under a constant contact pressure. Therefore, even if the key stem 7 is pushed down with the switch 1 in the "OFF" position, the movable spring contact 11 will not move downwardly until the base portion 7*a* of the key stem 7 abuts against the juncture between the legs 11*a* of the spring contact 11. More particularly, since the clearance or play 9 is still present between the juncture between the legs 11*a* of the movable spring contact 11 and the underside of the base portion 7*a* of the key stem 7 until the key stem 7 will abut against the leaf spring contact 11, even if the key stem 7 is pushed down with a slight finger pressure, the movable spring contact 11 will not immediately move downwardly and thus, the switch 1 will not be immediately moved to the "ON" position with such a slight finger pressure applied on the key stem 7. In addition, since the movable spring contact 11 is formed separately from the key stem 7, at the moment the key stem is moved in the "ON" or "OFF" direction, the movement of the key stem will not be immediately transmitted to the spring contact whereby even if the user's finger trembles or springs as he moves the key stem in the "ON" or "OFF" direction there will be no possibility to erroneously operate the switch. Therefore, the switch 1 can be positively protected against inadvertent actuation upon any erroneous application of force on the key stem 7 which may occur during the handling of the switch.

It is to be understood that variations and modifications of the invention may be made without departing from the scope of the invention. It is also to be understood that the scope of the invention is not to be interpreted as limited to the specific embodiment disclosed herein, but only in accordance with the appended claims when read in light of the foregoing disclosure.

What is claimed is:

1. A push button-type switch comprising in combination:

a rectangular casing including parallel side walls, parallel end walls, and a bottom wall, and opening at the top, said side, end and bottom walls defining a switching chamber therebetween, a key stem received within said switching chamber with a portion thereof extending upwardly through said open top of the casing for limited upward and downward movement, a return spring disposed externally of said casing about said extension of the key stem for normally urging the key stem in its uppermost position, a movable spring contact received within said switching chamber to be driven by said key stem and stationary contact means secured to said side walls to be engaged by said movable spring contact, said key stem including a bifurcated base portion with opposite legs at the lower end of the key stem disposed and received within opposite ends of said switching chamber and a cross bar extending between said legs in a spaced relationship to the underside of said base portion, and said movable spring contact comprises a substantially U-shaped leaf spring having a pair of legs connected at the upper ends and embracing said cross bar, said legs of the spring each having an outwardly warped contacting portion at the lower end adapted to engage said stationary contact means, whereby when said key stem is in its uppermost position a clearance is present between the underside of said base portion of the key stem and the top of said spring contact and when said key stem is in its lowermost position a clearance is present between the underside of said spring contact and said cross bar.

2. The push button-type switch as set forth in claim 1, each of said side walls of the casing includes an upper thicker wall portion against which the associated outwardly warped contacting portion of each of the legs of the spring contact abuts when said key stem is in its uppermost position, a lower thinner wall portion to which said stationary contact means is secured to be engaged by the associated outwardly warped contacting portion of each of the legs of the spring contact when said key stem is in its lowermost position and a slanted shoulder connecting between said upper thicker and lower thinner wall portions.

3. The push button-type switch as set forth in claim 1, in which said stationary contact means comprises a rectangular conductive metal plate having a depending terminal contacting portion which extends downwardly through said bottom wall of the casing.

4. The push button-type switch as set forth in claim 2, in which said movable spring contact has such resilience that the outwardly warped contacting portions at the lower ends of the legs of the spring contact are urged outwardly from each other whereby when said key stem is in its uppermost position the outwardly warped portions abut against said upper thicker wall portions of the casing side walls and when said key stem is in its lowermost position the outwardly warped portions abut against said stationary contact means secured to the thinner wall portions of the casing side walls.

* * * * *